US010244798B2

(12) United States Patent
Wexler

(10) Patent No.: US 10,244,798 B2
(45) **Date of Patent: *Apr. 2, 2019**

(54) UNDERGARMENT AND GUSSET THEREFOR

(71) Applicant: The Underwares Group, LLC, Chicago, IL (US)

(72) Inventor: Michelle Wexler, Chicago, IL (US)

(73) Assignee: The Underwares Group, LLC, Chicago, IL (US)

( * ) Notice: Subject to any disclaimer, the term of this patent is extended or adjusted under 35 U.S.C. 154(b) by 207 days.

This patent is subject to a terminal disclaimer.

(21) Appl. No.: 15/587,833

(22) Filed: May 5, 2017

(65) Prior Publication Data

US 2017/0238620 A1 Aug. 24, 2017

Related U.S. Application Data

(63) Continuation of application No. 13/211,925, filed on Aug. 17, 2011, now Pat. No. 9,713,351.

(51) Int. Cl.

| | |
|---|---|
| ***A41B 9/00*** | (2006.01) |
| ***A41B 9/02*** | (2006.01) |
| ***A41B 9/04*** | (2006.01) |
| ***A41B 9/12*** | (2006.01) |
| ***A41C 1/06*** | (2006.01) |
| ***A41D 1/06*** | (2006.01) |
| ***A41B 9/14*** | (2006.01) |

(52) U.S. Cl.

CPC ..... *A41B 9/04* (2013.01); *A41B 9/004* (2013.01); *A41B 9/12* (2013.01); *A41B 9/14* (2013.01); *A41D 1/06* (2013.01)

(58) Field of Classification Search

CPC ..... A41B 9/001; A41B 9/004; A41B 9/00; A41B 9/02; A41B 9/04; A41B 9/12; A41B 2400/38; A41B 2400/52; A41B 2500/10; A41D 7/005; A41D 1/06

USPC ..... 2/238, 400–409; 450/94, 100, 104, 105, 450/115, 132

See application file for complete search history.

(56) References Cited

U.S. PATENT DOCUMENTS 549,048 A * 10/1895 Basch ..... A41D 1/088 2/227
D39,760 S * 1/1909 Moses ..... D2/705
(Continued)

FOREIGN PATENT DOCUMENTS

JP 2006322100 A * 11/2006
JP 2006322120 A * 11/2006

*Primary Examiner* — Jameson D Collier
(74) *Attorney, Agent, or Firm* — Seyfarth Shaw LLP

(57) ABSTRACT

An improved, substantially elongated gusset and/or crotch panel, incorporated into garments for humans' lower bodies. This novel, uniquely shaped, and scaled gusset significantly enhances wearers' comfort by eliminating seams, material transitions, stitching, and other mechanisms or methods of attachment from within the boundaries of a defined protected region, which coincides with the wearer's sensitive genital area. The gusset is preferably constructed from at least one layer of material, and may feature additional layers. In preferred embodiments, the elongated gusset and/or crotch panel is incorporated into girl/boy short-style undergarments, bikini-style undergarments, thong-style undergarments, pajama-bottom style garments, and other lower-body garments.

18 Claims, 13 Drawing Sheets

(56) References Cited

U.S. PATENT DOCUMENTS 1,679,206 A * 7/1928 Crossingham ..... A41B 9/08 2/113
1,808,614 A * 6/1931 Stein ..... A41B 9/08 2/46
2,003,654 A * 6/1935 Polson ..... A61F 13/64 604/401
2,013,554 A * 9/1935 De Benedetto ..... A41D 7/00 2/52
2,232,246 A * 2/1941 Klein ..... A41B 9/02 2/238
2,285,692 A * 6/1942 Wickman ..... A41D 13/02 2/227
2,306,514 A * 12/1942 Wilker ..... A41D 1/06 2/227
2,321,123 A * 6/1943 Bogart ..... A41B 9/02 2/403
2,363,959 A * 11/1944 Hanes ..... A41B 9/007 2/78.2
2,435,945 A * 2/1948 Redmond ..... A41B 9/04 2/406
D160,328 S * 10/1950 Marks ..... D2/712
D165,872 S * 2/1952 Royce ..... D2/712
2,617,112 A * 11/1952 Neilson ..... A41B 9/04 2/407
2,629,094 A * 2/1953 Goldsmith ..... A41D 1/08 2/23
2,739,314 A * 3/1956 Friedman ..... A41B 9/02 2/403
2,809,510 A * 10/1957 West ..... D04B 1/24 2/402
3,237,625 A * 3/1966 Johnson ..... A41B 13/04 2/406
3,314,422 A * 4/1967 Phillips ..... A41B 9/02 128/846
3,339,208 A * 9/1967 Marbach ..... A41B 9/002 128/891
3,411,504 A * 11/1968 Glassman ..... A61F 13/47218 604/380
3,570,491 A * 3/1971 Sneider ..... A61F 13/47236 604/366
D228,034 S * 7/1973 Krusko ..... D24/126
D231,142 S * 4/1974 Koury ..... D24/126
D231,274 S * 4/1974 Krusko ..... D24/126
D234,162 S * 1/1975 Andersen ..... D24/125
RE28,483 E * 7/1975 Ralph ..... A61F 13/68 604/397
3,894,542 A * 7/1975 Sacristan ..... A41C 1/003 450/123
3,909,847 A * 10/1975 Holt ..... A41D 1/088 128/846
D243,561 S * 3/1977 Alvarez ..... D2/713
4,014,044 A * 3/1977 Figueroa ..... A41B 9/02 128/883
4,072,151 A * 2/1978 Levine ..... A61F 13/53717 604/387
D252,656 S * 8/1979 Bergh ..... D2/703
D256,288 S * 8/1980 Stern ..... D2/708
4,280,230 A * 7/1981 LaFleur ..... A61F 13/72 2/406
4,352,356 A * 10/1982 Tong ..... A61F 5/4401 604/372
4,355,425 A * 10/1982 Jones ..... A41B 9/004 2/402
4,394,781 A * 7/1983 Axmann ..... A41D 7/005 2/238
4,490,856 A * 1/1985 Dost ..... A41D 7/005 2/238
4,548,603 A * 10/1985 Ichijo ..... A61F 13/42 428/16
4,581,771 A * 4/1986 Williams ..... A41D 27/12 2/408
4,602,388 A * 7/1986 Underwood ..... A41D 1/08 2/238
D293,617 S * 1/1988 Barrett ..... D2/742
D301,080 S * 5/1989 Gay, Jr. ..... D2/731
4,838,886 A * 6/1989 Kent ..... A61F 13/49004 2/111
4,917,697 A * 4/1990 Osborn, III ..... A61F 13/47236 604/387
5,114,419 A * 5/1992 Daniel ..... A41B 9/00 128/891
5,131,386 A * 7/1992 Simmons ..... A41B 9/02 2/401
5,167,655 A * 12/1992 McCoy ..... A61F 7/10 2/406
D336,549 S * 6/1993 Stabile ..... D24/124
5,274,854 A * 1/1994 Wenner ..... A41B 9/02 2/400
5,325,543 A * 7/1994 Allen ..... A61F 13/74 2/400
D352,151 S * 11/1994 Warnock ..... D2/704
5,388,275 A * 2/1995 Oram ..... A41D 1/088 2/400
D356,660 S * 3/1995 Leonard ..... D2/704
5,396,662 A * 3/1995 Leonard ..... A41D 7/005 2/400
D359,609 S * 6/1995 Deslippe ..... D2/742
D360,971 S * 8/1995 Speth ..... D2/705
5,514,104 A * 5/1996 Cole ..... A61F 5/4401 604/358
D378,700 S * 4/1997 Taylor ..... D24/124
5,620,430 A * 4/1997 Bamber ..... A61F 13/472 604/373
5,651,779 A * 7/1997 Burrell ..... A61F 13/72 2/401
D384,152 S * 9/1997 Raufman ..... D24/126
5,713,884 A * 2/1998 Osborn, III ..... A61F 13/47218 604/373
5,729,835 A * 3/1998 Williams ..... A61F 13/47254 2/400
5,778,457 A * 7/1998 Conway ..... A61F 13/5605 2/267
5,832,535 A * 11/1998 Davis ..... A41B 9/001 2/1
5,870,778 A * 2/1999 Tharpe ..... A61F 13/64 2/311
D411,007 S * 6/1999 Peck ..... D24/126
D414,914 S * 10/1999 Rauterkus ..... D2/853
6,042,575 A * 3/2000 Osborn, III ..... A61F 13/15203 604/385.23
D424,195 S * 5/2000 Talon ..... D24/124
D425,687 S * 5/2000 Gonzalez ..... D2/742
6,093,178 A * 7/2000 Osborn, III ..... A61F 13/47227 604/385.24
6,107,572 A * 8/2000 Miyazaki ..... H01R 9/0518 174/75 C
6,156,951 A * 12/2000 Gustafsson ..... A61F 13/471 604/358
6,210,387 B1 * 4/2001 Rudberg ..... A61F 13/49009 604/358
6,231,556 B1 * 5/2001 Osborn, III ..... A61F 13/15203 604/358
D444,231 S * 6/2001 Renz ..... D24/124
D444,554 S * 7/2001 O'Hara ..... D24/125
D445,498 S * 7/2001 Renz ..... D24/124
6,313,371 B1 * 11/2001 Conant ..... A61F 13/47 604/359
6,397,397 B1 * 6/2002 Chen ..... A41C 3/0014 2/243.1
6,398,770 B1 * 6/2002 Drevik ..... A61F 13/47218 604/385.01
6,409,712 B1 * 6/2002 Dutari ..... A61F 13/471 604/346
D460,818 S * 7/2002 Levy ..... D24/124
6,463,591 B1 * 10/2002 Toratani ..... A41B 9/001 2/400
D466,608 S * 12/2002 Magee ..... D24/126
D474,273 S * 5/2003 Yamamoto ..... D24/125

(56) References Cited

U.S. PATENT DOCUMENTS 6,557,183 B1 * 5/2003 Truong ..... A41B 9/02 2/403
6,560,786 B2 * 5/2003 Lipton ..... A41B 9/008 2/400
6,565,548 B1 * 5/2003 Glaug ..... A61F 5/453 604/349
D476,082 S * 6/2003 Gell ..... D24/125
D482,782 S * 11/2003 Glaug ..... D24/124
D483,481 S * 12/2003 Ceman ..... D24/125
D483,866 S * 12/2003 Pollard ..... D24/125
D486,228 S * 2/2004 Fonseca ..... D24/125
D489,451 S * 5/2004 Glaug ..... D24/126
D489,821 S * 5/2004 Glaug ..... D24/126
6,807,685 B1 * 10/2004 Hasegawa ..... A41B 9/004 2/400
6,824,535 B2 * 11/2004 Kolby-Falk ..... A61F 13/5611 604/385.03
D500,131 S * 12/2004 Choice ..... D24/125
6,908,456 B1 * 6/2005 Drevik ..... A61F 13/47254 604/385.01
D516,731 S * 3/2006 Harris ..... D24/208
D528,656 S * 9/2006 Glaug ..... D24/124
7,100,214 B1 * 9/2006 Murray ..... A41C 1/003 2/406
D537,525 S * 2/2007 Buchanan ..... D2/712
7,172,584 B2 * 2/2007 Karami ..... A61F 13/475 604/378
7,288,080 B2 * 10/2007 Edens ..... A61F 13/47209 604/385.17
7,291,136 B1 * 11/2007 Drevik ..... A61F 13/47254 604/385.01
D560,802 S * 1/2008 Stratton ..... D24/126
7,316,673 B2 * 1/2008 Drevik ..... A61F 13/4702 604/358
7,341,579 B2 * 3/2008 Kinoshita ..... A61F 13/4753 604/385.03
D571,534 S * 6/2008 Rudolph ..... D2/713
7,430,766 B2 * 10/2008 Coccia ..... A41D 1/084 2/228
D589,611 S * 3/2009 Parker ..... D24/124
D593,200 S * 5/2009 Gagliardi ..... D24/124
7,628,778 B2 * 12/2009 Zehner ..... A61F 13/15203 604/385.01
7,662,138 B2 * 2/2010 Hermansson ..... A61F 13/49011 156/229
7,669,248 B2 * 3/2010 Toratani ..... A41B 9/004 2/109
7,752,681 B2 * 7/2010 Michel ..... A41B 9/00 2/409
7,799,007 B2 * 9/2010 Hermansson ..... A61F 13/4915 604/393
7,842,022 B2 * 11/2010 Vegli ..... A61L 15/58 604/386
7,854,022 B2 * 12/2010 Warren ..... A41D 27/245 2/401
7,857,798 B2 * 12/2010 Buettner ..... A41B 9/002 604/361
7,931,639 B2 * 4/2011 Suga ..... A61F 13/72 2/109
D638,118 S * 5/2011 Mateo ..... D24/126
D638,119 S * 5/2011 Mateo ..... D24/126
7,941,872 B2 * 5/2011 Martz ..... A41B 9/04 2/406
7,993,322 B2 * 8/2011 Brud ..... A61F 13/496 604/393
D646,047 S * 10/2011 Arensdorf ..... D2/712
8,042,194 B2 * 10/2011 Connor ..... A61F 13/47236 2/272
D660,551 S * 5/2012 Steele ..... D2/712
D663,920 S * 7/2012 Wexler ..... D2/712
D663,921 S * 7/2012 Wexler ..... D2/712
8,230,520 B2 * 7/2012 Riondato ..... A41D 1/084 2/275
8,292,862 B2 * 10/2012 Dennis ..... A61F 13/15203 604/385.03
D675,809 S * 2/2013 Silva ..... D2/742
D679,004 S * 3/2013 Norman ..... D24/124
8,419,699 B2 * 4/2013 Giloh ..... A61F 13/47245 604/385.01
D681,913 S * 5/2013 Wexler ..... D2/712
D690,898 S * 10/2013 Wexler ..... D2/712
D690,899 S * 10/2013 Wexler ..... D2/712
D690,900 S * 10/2013 Wexler ..... D2/712
D690,901 S * 10/2013 Wexler ..... D2/712
D690,902 S * 10/2013 Wexler ..... A41B 9/004 D2/712
D690,903 S * 10/2013 Wexler ..... A41B 9/004 D2/712
9,713,351 B2 * 7/2017 Wexler ..... A41B 9/004
D836,790 S * 12/2018 Jackson ..... D24/206
2002/0065497 A1 * 5/2002 Kolby-Falk ..... A61F 13/47227 604/368
2003/0217407 A1 * 11/2003 Andrews-Jones ..... A41B 9/00 2/400
2004/0068247 A1 * 4/2004 Connor ..... A61F 13/47236 604/387
2004/0092898 A1 * 5/2004 Schfer ..... A61F 13/15203 604/367
2004/0230175 A1 * 11/2004 Rainville-Lonn ..... A61F 13/74 604/396
2005/0009446 A1 * 1/2005 Arnold ..... A41B 9/001 450/100
2005/0066408 A1 * 3/2005 Varela ..... A41D 27/12 2/69
2006/0101558 A1 * 5/2006 Coleman ..... A41D 13/1254 2/400
2007/0060901 A1 * 3/2007 Alletsee ..... A61F 13/471 604/385.09
2007/0124850 A1 * 6/2007 Buettner ..... A41B 9/002 2/401
2008/0222781 A1 * 9/2008 Rhew ..... A41B 9/004 2/406
2008/0229487 A1 * 9/2008 Kweon ..... A41B 9/001 2/405
2008/0276352 A1 * 11/2008 Strange ..... A41B 17/00 2/401
2008/0282451 A1 * 11/2008 Simpson ..... A41B 9/14 2/406
2008/0312630 A1 * 12/2008 Seo ..... A61F 13/4758 604/385.03
2009/0049576 A1 * 2/2009 Toratani ..... A41B 9/004 2/67
2009/0131899 A1 * 5/2009 Ross ..... A61F 13/47209 604/385.03
2009/0139003 A1 * 6/2009 Lee ..... A41B 9/00 2/54
2009/0240225 A1 * 9/2009 Noda ..... A61F 13/474 604/378
2010/0049154 A1 * 2/2010 Burd ..... A61F 13/4702 604/379
2010/0095442 A1 * 4/2010 Kuipers ..... A41D 1/084 2/466
2010/0152687 A1 * 6/2010 Carlozzi ..... A41B 9/04 604/359
2010/0175170 A1 * 7/2010 Dye ..... A41B 9/002 2/406
2010/0180359 A1 * 7/2010 Andrews ..... A41B 9/002 2/69
2010/0191205 A1 * 7/2010 Carbonari ..... A61F 13/472 604/359
2012/0311770 A1 * 12/2012 Nakajima ..... A61F 13/49011 2/401
2012/0324632 A1 * 12/2012 Hurvitz ..... A41B 9/001 2/400

(56) References Cited

U.S. PATENT DOCUMENTS

| | | | | |
|---|---|---|---|---|
| 2013/0018344 | A1* | 1/2013 | Dennis | A61F 13/15203 604/368 |
| 2013/0263362 | A1* | 10/2013 | Wexler | A41B 9/004 2/400 |
| 2014/0101826 | A1* | 4/2014 | Nearman | A41B 9/04 2/407 |

* cited by examiner

UNDERGARMENT AND GUSSET THEREFOR

RELATED APPLICATIONS

This application is a continuation of and claims the benefit of U.S. patent application Ser. No. 13/211,925, entitled Novel Undergarment and Gusset Therefor, the content of which is incorporated herein by reference in its entirety.

BACKGROUND OF THE INVENTION

This invention relates generally to garments for humans' lower bodies, and more particularly, but not exclusively, to a novel substantially elongated gusset that is incorporated into said garments, where said gusset substantially increases comfort to the wearer through the improvement of, among other aspects, relocating anterior gusset edges, seams, material transitions, and implements of attachment outside of a defined protected region coinciding with the wearer's sensitive genital region.

There are several varieties of women's undergarments currently commercially available. Among currently available styles are: hipsters, bikinis, thongs, g-strings, tangas, boy/girl-shorts, hot pants, grannies and c-strings; as well as adhesive varieties, including styles that adhere directly to the body, and those that are applied directly to outer garments Despite variations in the cut, shape, fabric, etc., among different brands and styles of women's undergarments, currently available designs feature similar crotch panels and gussets that do not offer the wearer an optimal level of comfort.

Gussets are generally rectangular, diamond-shaped, triangular, or square pieces of material which are sewn onto the crotch panel of undergarments; or inserted into seams to add breadth, reduce stress, or cover joints.

Currently known, available incarnations of undergarments incorporate gussets, crotch region pieces and/or gusset liners that are highly problematic in that they are designed and constructed in a manner such that the edges of the gusset; the material transitions between the gusset and garment body material, and the seams and stitching which serves to attach the pieces all exist within a sensitive genital region of the wearer, causing discomfort, abrasion, and irritation.

For most known, currently available boy/girl-short styles of undergarments, the body of the undergarment is constructed from multiple pattern pieces that are sewn together in the crotch region, with the juncture of the pattern pieces being inopportunely located within the wearer's sensitive genital region. In known, prior garments, a small gusset may be attached to the crotch region of the garment in at least one location, which serves to attempt to shield the wearer's sensitive genital region from the seams linking the multiple body pattern pieces. However, the seams are raised, raw, rough, and located on the inner face of the garment; and as a result of the uniting of separate pattern pieces and their respective edges, the seams are resultantly thicker, more irregularly textured, and consequently more tactilely detectable. This renders contact with them more irritating, abrasive, and undesirable than contact with an expanse of flat, seamless fabric. In such garments, even a larger gusset does not adequately compensate for the thickness and presence of the ridges generated by the seams resulting from the joined pattern pieces; which thereby cause discomfort for the wearer, despite the presence of any overlaid gusset.

In currently available undergarments, the second ply of the gusset or gusset liner may either be stitched to the body of the undergarment on all four sides or left unsecured at the top front edge, thereby creating a flap of fabric with an irregular textured edge. Whether secured or left as untethered flaps, the front edges of the gussets in known, current products do not extend far enough toward the front of the undergarments, toward the navel and the waistband, such that these edges directly contact wearers' genital region and can cause chafing and discomfort.

Additionally, many undergarments feature designs where the gusset and/or crotch panel pieces are fashioned from one fabric, and the body pieces of the garment are constructed from another fabric that is less suitable in texture and composition for the genital region. Since the gussets in these products do not extend far enough up the front inner face of the garment toward the navel, the transition from the gusset fabric to the body fabric typically occurs well within the sensitive genital region, such that the wearer's sensitive genital region is forced into direct contact with the seams generated by the fabric transition and the potentially uncomfortable body fabric.

Moreover, many existing undergarments for women suffer from design flaws that cause them to migrate up the wearer's body and become wedged into the crevice between the buttocks. Specifically, many existing boy/girl-short undergarment designs feature a vertical seam that joins the multiple body pattern pieces which runs along the midline of the front and/or rear faces of the body of the undergarment. The location of this seam directly between the wearer's buttocks often causes the garment to migrate inward, and eventually settle between the buttocks. Furthermore, as existing gussets and/or crotch panels are of insufficient size, they do not impede the progression of the seams of the undergarment as it rides up the wearer's body and lodges into the crevice between the wearer's labia.

In order to prevent upwards migration of bikini-style undergarments, the current state of the art is to line the circumference of the leg openings with rubberized, plastic, or silicone nonslip treads. These treads can cause skin irritation, ingrown hairs, and/or roll upwards if displaced through movement or friction with clothing, which consequently renders said leg bands ineffective. The spatial orientation of currently available rubber treads and elastic leg bands on current undergarment styles do not adequately and successfully anchor the undergarment in place, and therefore do not sufficiently prevent upwards migration. Additionally, these rubber and plasticized treads and elasticized leg bands often result in undesirable garment demarcation lines that are often easily visible through outer clothing.

There are also several varieties and styles of undergarments that purportedly shape the human form, and minimize the appearance of certain bodily areas, such as the thighs, buttocks, or "saddlebags", which are commonly understood to be the region surrounding the junction of the upper leg and the bottom of the buttock. However, these undergarments are constrictive by necessity of their design and generally made from non-breathable, synthetic fabrics. Most importantly, these products have gussets of insufficient size that fail to protect the wearer from uncomfortably located fabric transitions and seams.

There are also existing styles of undergarments that are designed to reduce the appearance of undergarment lines through outer clothing and provide increased comfort to the wearer. They are generally promoted as being "ultra thin," or "like wearing nothing at all." Such products do not, however, aid in improving the appearance of the wearer's body, prevent upwards migration, or in reality, offer any meaningful enhancement to the wearer's comfort.

In fact, the sensitive genital region actually benefits from more protection against outer garments, not less. Since outerwear is usually constructed from thicker, rougher textiles; it generally results in thicker, rougher seams. A thinner, flimsier undergarment garment offers less protection from these seams; which subsequently offers the wearer a lower level of comfort.

Additionally, many of these undergarments are constructed from synthetic materials, which result in reduced breathability and thus render the wearer more prone to an imbalance in personal body chemistry; which ultimately places the wearer at risk for developing vaginal infections. The thinness of the body fabric and the lack of sturdy anchoring leg or waistbands may also cause these undergarments to displace during wear.

Some esoteric styles of undergarments are designed for and marketed to populations who engage in specialty athletic pursuits; such as biking, equestrian sports; or any other sports which cause predictable repetitive impact or periods of prolonged direct pressure on the genital region. These garments typically feature a more utilitarian appearance, and often employ thickened and padded gussets; as well as additional thickened and padded regions; which exist for the purpose of protecting the wearer from genital injury that would reasonably be expected to be sustained as a direct result of participating in their respective athletic activity. The synthetic fabrics, padding and thickened regions also serve to trap body heat, which results in the wearer experiencing an elevation in temperature perception. Although mesh panels are sometimes incorporated to counteract the accumulation of heat, it is an imperfect remedy; and one which also results in demarcation lines and patterns that are detectable through outer clothing. These specialized garments are designed to maximize athletic performance and experience; not to increase the comfort level of the wearer's entire genital region in a non-athletic setting. They are not designed or suitable for regular daily wear, under normal outerwear, over extended periods of time.

Existing styles of pajama bottoms also suffer from many of the shortcomings described above. Traditionally, pajama bottoms are constructed from two leg pattern pieces sewn together which are then joined at the crotch with an "X" shaped seam, then attached to a waistband section. Typically, the "X" shaped seam runs directly through and directly bisects the crotch area; in a manner where the raw seams, which are located on the inside of the garment, are directly centered on the most sensitive area in the entire genital region. The presence of raised, raw, abrasive, uncovered seams in this area does not offer optimal comfort for the wearer. Furthermore, a wearer's movements during sitting and/or sleep can cause the crotch panel of the garment to ride upwards and into direct contact with the wearer's sensitive genital region, often becoming painfully wedged in the crevice between the buttocks, and/or the labia. Existing pajama bottoms do not feature a strategy to protect the wearer's genital region from these exceptionally uncomfortable, raw, rough, uncovered seams and exposed stitching.

BRIEF SUMMARY OF THE INVENTION

The present invention provides an improved elongated gusset that is incorporated into a garment, preferably for women, featuring gusset and/or crotch panel attachment seams, pattern piece junctions and material transitions that are located exclusively outside of a defined "protected region," which is generally defined as the sensitive genital region that includes, but is not limited to, the Mons Veneris, the Mons Pubis, the pudendal cleft, the anterior labial commisure, the angle of the clitoris, the prepuce, the clitoral hood, and the vulva. Gussets, gusset liners, and crotch panels, as those terms are used herein, include the pieces, sections, segments or expanses of material which are utilized in a garment within a crotch region of a wearer; or that contact or cover at least a portion of the area identified as the protected region.

A preferred gusset of the present invention is made from at least one layer of material and extends further up the inner front and/or rear faces of the body piece(s) of said undergarment than in the prior art. All four edges of the gusset, or gusset liner in a multi-ply embodiment, may be attached to the body of the undergarment. The waistband can be made from or with stretchable material, and is situated high enough on the body, anterior to the Mons Veneris and Pubis so that attachment to the body of the garment is outside of the protected region. Some embodiments of the invention feature an undergarment with stretchable leg bands. The invention also encompasses the design for an elongated gusset that comprises the crotch panel of garments for humans' lower bodies; and methodology of construction that serves to shield the wearer's protected region from exposed, raw seams. In one such methodology, seams impacting the protected region are located on the outer face of the garment, to provide superior comfort.

The present invention provides several significant advantages over the prior art. First, the invention eliminates contact between the wearer's protected region and any seams, flaps, ridges, fabric transitions, or stitching. This is due, among other features, principally to the elongation of the gusset to a length where its edges and attachment seams fall well outside the protected region.

Second, the elongated gusset of the present invention increases comfort by more extensively shielding a greater surface area of the wearer's genitalia from the material comprising the body of the undergarment, than in the prior art. A larger, elongated gusset enables more of the protected region to be in direct contact with the often softer and more texturally appealing gusset material. This design thereby prevents uncomfortable transitions between the gusset piece material and the body piece material within the protected region.

Third, this invention allows for removal of seams from the protected region, which increases the wearer's comfort.

Fourth, in most preferred embodiments, this invention eliminates vertical seams from between the wearer's buttocks, thereby reducing the garment's ability to migrate upwards and settle in undesirable locations.

Fifth, stretchable leg bands featured on certain embodiments grip the wearer's body without being constrictive, thereby anchoring the garment in its proper position and reducing the garment's upwards migration, and subsequently settling into the cleft between the buttocks.

Sixth, the strategic location of said leg bands serves to reduce the appearance of demarcation lines visible through outer clothing. This is accomplished by locating the transition from the body of the undergarment to the leg band within the crease where the wearer's buttocks meet the top of the wearer's leg. These leg bands also serve to camouflage cellulite on and/or contain the shape of the wearer's upper leg area, which many people find to be aesthetically problematic.

Additionally, removing seams from the Mons Veneris and Pubis serves to reduce irritation from hair regrowth which is problematic for those who elect to engage in the practice of pubic hair removal.

Finally, the elongated gusset, as incorporated into garment bottoms, provides an improved, flat, seamless platform within the boundaries of the protected region, that prevents the gusset and or crotch panel from migrating too far upwards and settling into creases of the wearer's genitalia. It also provides a soft, flat, seamless platform for the genital region to eventually come to rest upon when the fabric panel inevitably makes contact with the wearer's body. This design also improves the wearer's comfort by featuring seams that are only located outside of the specified protected region.

DETAILED DESCRIPTION OF PREFERRED EMBODIMENTS OF THE INVENTION

Figure 1:
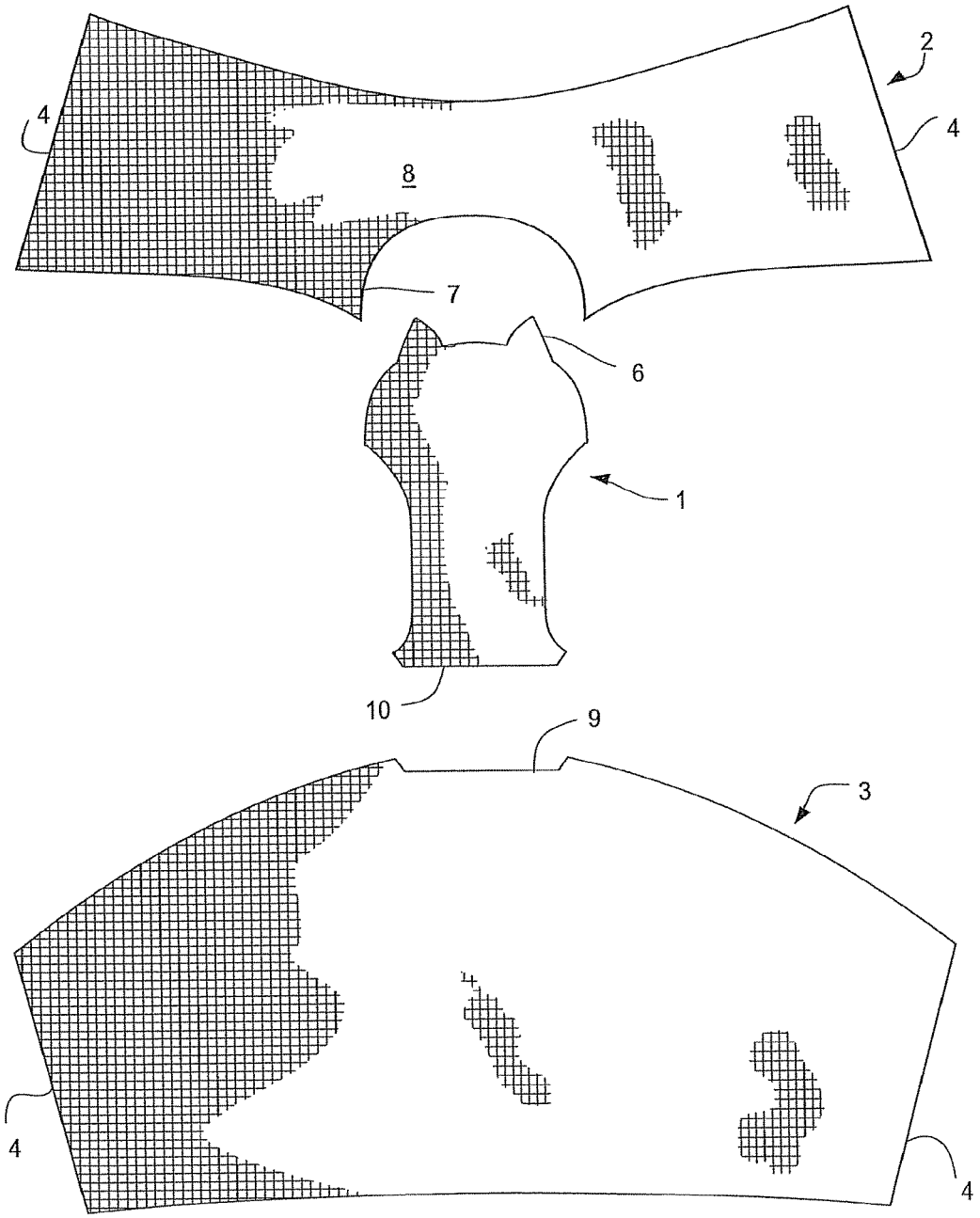
FIG. 1 is a plan view of the pattern pieces that comprise the body of an undergarment for women into which the elongated gusset piece is incorporated, in accordance with one preferred embodiment of the invention.
Figure 2:
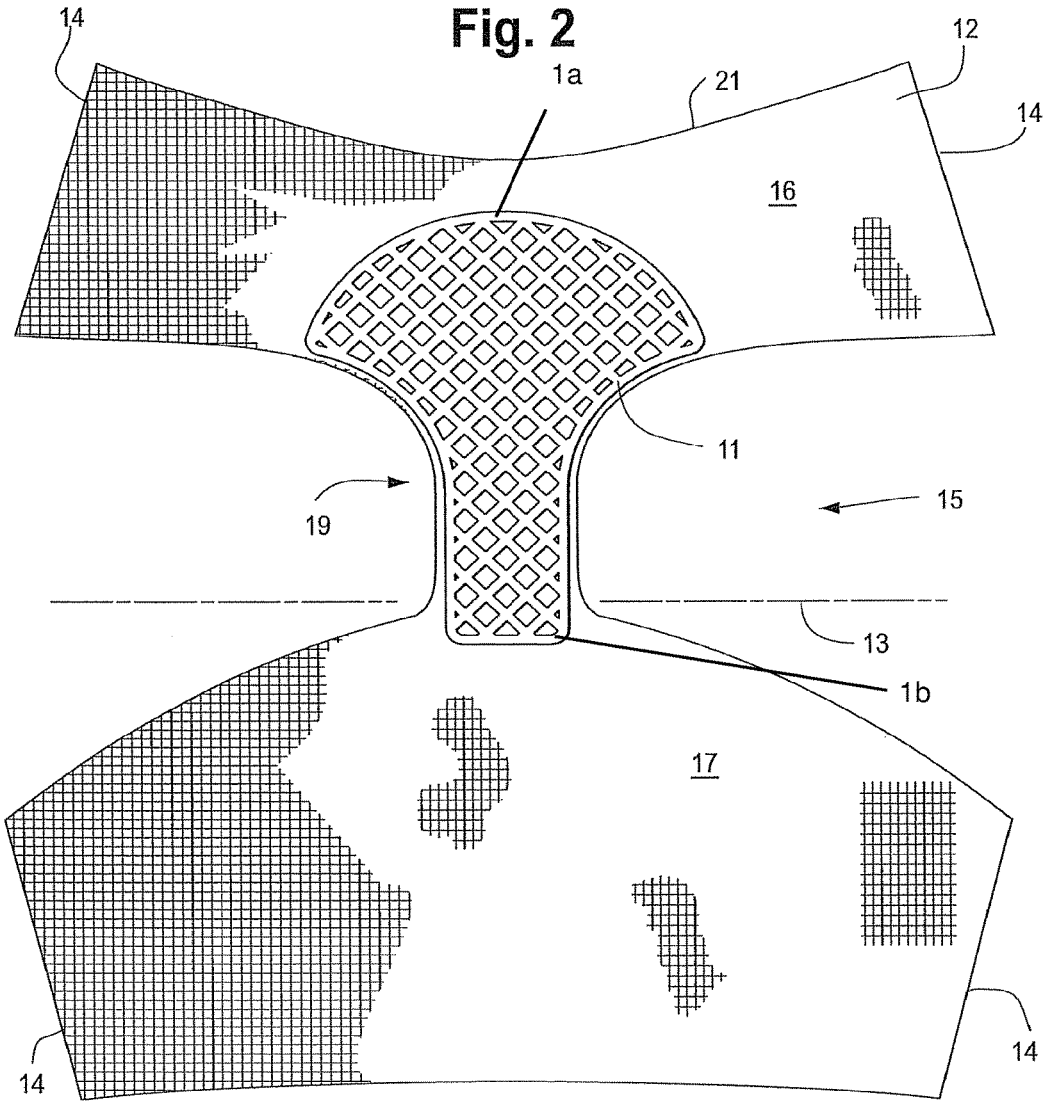
FIG. 2 is a plan view of a single body pattern piece with two non-symmetrical halves relative to a horizontal axis, and identifies a general protected region, in accordance with one preferred embodiment of the invention.

In a first preferred embodiment ("girl short #1"), there are three body pattern pieces as shown in FIG. 1: an elongated gusset pattern piece 1, a front pattern piece 2, and a rear pattern piece 3. Front pattern piece 2 and rear pattern piece 3 are attached along the sides 4 of the legs, parallel to the wearer's hips. Gusset pattern piece 1 can be constructed from a single layer of any material, including the same fabric as the body pieces, and of any suitable material, such as but not limited to cotton, silk, modal or bamboo. Gusset pattern piece 1 can also comprise one or multiple layers of material, which can be the same or different material than the rest of the garment. As shown, gusset pattern piece 1 is placed on top of the inner face of one additional gusset pattern piece and attached along its edges, thereby forming a multi-ply gusset 1. Gusset 1 can also be cut into a recognizable shape, such as the outline of a logo icon; or any recognizable shape, figure, or outline As seen in FIG. 1, the top portion 6 of gusset 1 forms the outline of a feline shape. Front pattern piece 2 features a cut-out 7; where top portion 6 of gusset 1 substantially nests with cut-out 7 in such a way that there is slight overlap for attachment. Gusset 1 is placed over cut-out 7 on front pattern piece 2 and attached along the overlap or nesting area. Cut-out 7 on front pattern piece 2 preferably extends a sufficient distance up the inner front face 8 of front pattern piece 2 toward the waistband, so as to avoid stitching, seams, fabric transitions, or other discomfort-causing phenomena within the protected region 11, as shown in FIG. 2. It has been determined that a gusset extending from a bottom edge of an undergarment, (as when it is on a flat surface where the 2 leg openings are situated next to each other) to approximately 75% towards the waistband will generally avoid the protected region. Of course, depending upon the size of and rise of the garment and the wearer, the gusset may extend from approximately 33% to 100%. Rear pattern piece 3 also features a cut-out 9, where the rear portion 10 of gusset 1 fits into cut-out 9 in such a way that there is slight overlap for attachment. Rear portion 10 of gusset 1 is attached to rear pattern piece 3 along this slight overlap, such that the resulting material juncture seam is located outside of protected region 11. The edges can include a top front edge near the top portion 6 and a read edge near the rear portion 10. The gusset 1 can include a front area 1*a* near the front face 16, and a rear area 1*b* near the rear face 17, where in the garment is configured to project outward more at the rear face 17 as compared to the front face 16, and/or the rear face 17 has more surface area than the front face 16. The front area 1*a* of the gusset 1 is larger than the rear area 1*b* of the gusset 1. As shown, the gusset 1 includes two side edges, the top front edge, and the rear edge that collectively form an outer edge that defines an outline. A transverse axis bisects an elongated length of the gusset 1, wherein a portion of the gusset 1 bound by the transverse axis, a portion of each of the side edges and the top front edge define the front area 1*a* of the gusset 1, and a portion of the gusset 1 bound by the transverse axis, a portion of each of the side edges and the rear edge define a rear area 1*b* of the gusset 1.

Figure 3:
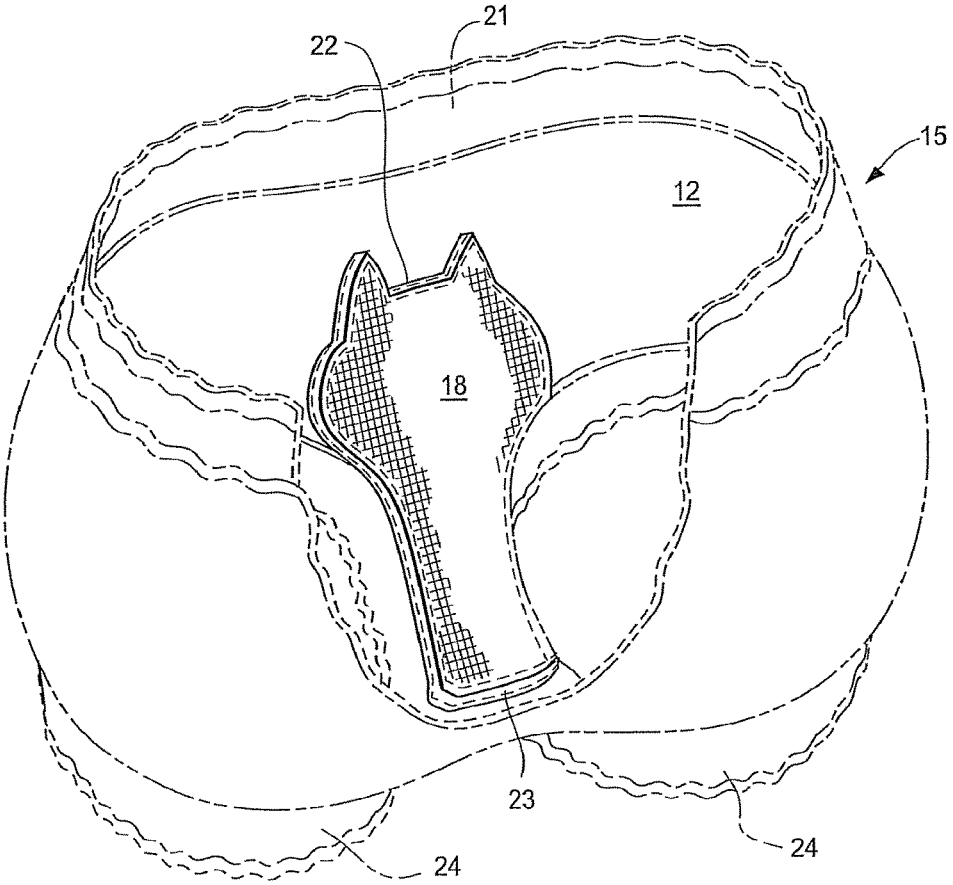
FIG. 3 is a rear perspective view of an elongated gusset piece with a front edge having an outline of a recognizable shape, as incorporated into an undergarment for women constructed from a single body pattern piece, in accordance with one preferred embodiment of the invention.
Figure 4:
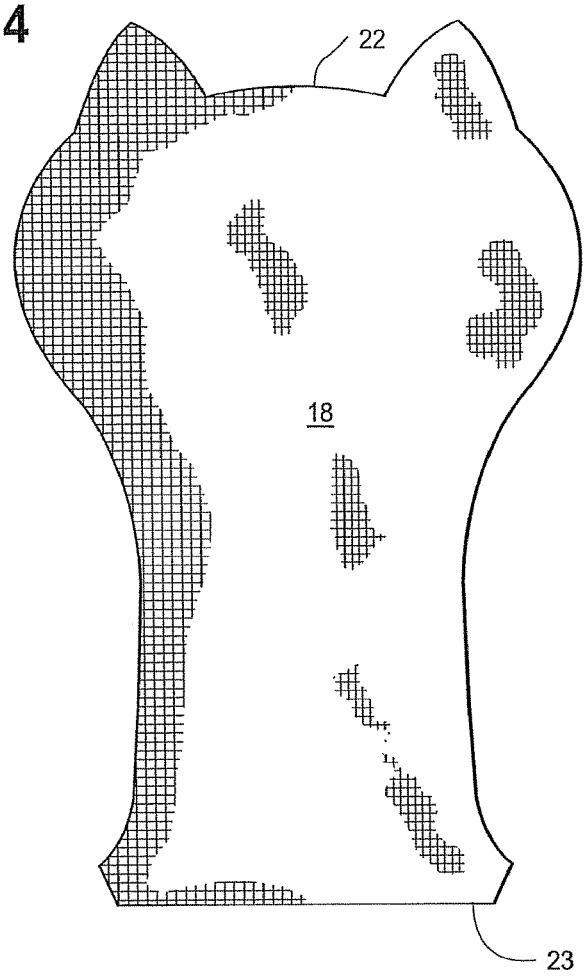
FIG. 4 is a plan view of an elongated gusset piece with top portion forming an outline of a recognizable shape, in accordance with one preferred embodiment of the invention.
Figure 4A:
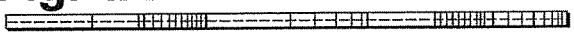
FIG. 4A is a front elevation view of the elongated gusset piece shown in FIG. 4 which may be constructed from multiple layers.
Figure 4B:
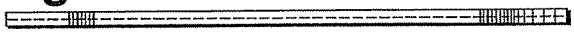
FIG. 4B is a rear elevation view of the elongated gusset piece shown in FIG. 4 which may be constructed from multiple layers.
Figure 4C:
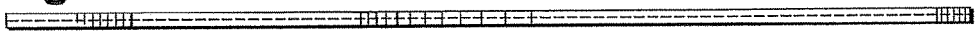
FIG. 4C is a right and left side elevation view of the elongated gusset piece shown in FIG. 4 which may be constructed from multiple layers.

In a second preferred embodiment ("girl short #2"), as seen in FIG. 2, there is a single body pattern piece 12 with two non-symmetrical halves (relative to a horizontal axis 13) that is folded over horizontal axis 13 and attached along the sides 14, parallel to the wearer's hips, to form the body of the undergarment 15, as shown in FIG. 3. Accordingly, there are no seams along the front face 16 or rear face 17 of undergarment body 15, or in protected region 11. An elongated gusset piece 18 (such as shown, for example in FIGS. 3, 4) may be affixed to the middle section 19 of body piece 12, such that the attachment runs along the top and bottom, or along the four edges, of gusset piece 18. Gusset piece 18 can become wider as it extends outward along inner front face 16 and rear face 17 of the body piece 12 toward the waistband 21. The front edge 22 of gusset piece 18 extends at least to a point above protected region 11, and extends sufficiently up inner front face 16 of body piece 12 toward waistband 21. The rear edge 23 of gusset 18 is attached to body piece 12, also outside of protected region 11, as seen in FIG. 3. Front edge 22 of gusset piece 18 can be fashioned into a recognizable shape, or figure, or outline, such as the outline of a logo icon, with front edge 22 of gusset piece 18 preferably extending at least up inner front face 16 of body piece 12 to be outside protected region 11. As shown, gusset piece 18 extends approximately 83% from the bottom edge of garment 15 to the waistband. Gusset piece 18 can be constructed from a single layer, or multiple layers, of any, material including the same material as body piece 12, such as but not limited to cotton, silk, modal, or bamboo, or any other fabric or material.

For both the first and second preferred embodiments, body pieces 2, 3, 12, 15 of the undergarments can be made from one or more of a multitude of materials, including but not limited to cotton, polyester, lace, silk, modal, bamboo, rayon, LYCRA® (a type of spandex fiber), or spandex. Stretchable waistband 21 can be included around the upper circumference of body 15 of the undergarment. Stretchable leg bands 24 can also be attached around the circumference of each leg hole, where leg bands 24 and leg portions of the undergarment have varying dimensions, which are properly scaled and adjusted for varying material elasticity so as to accommodate the leg circumference of wearers sized 0-24, and XS through XXL. Leg bands 24 can preferably be made from material that camouflages and/or contains perceived imperfections on the wearer's upper thigh and lower buttock region.

Figure 5:
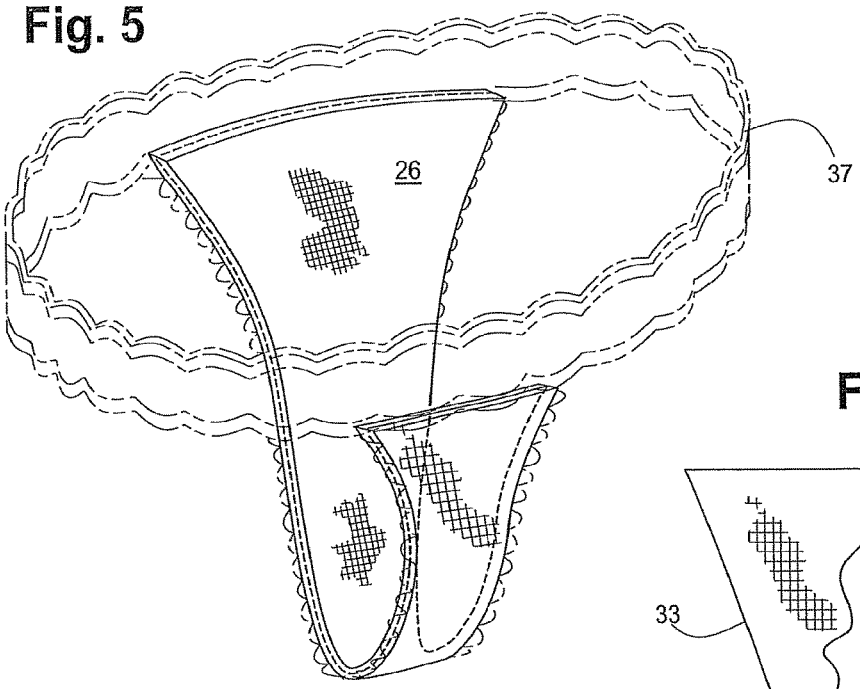
FIG. 5 is a rear perspective view of an elongated gusset piece as attached onto a body pattern piece of commensurate size, which was then attached to a stretchable waistband loop, in accordance with one preferred embodiment of the invention.
Figure 6:
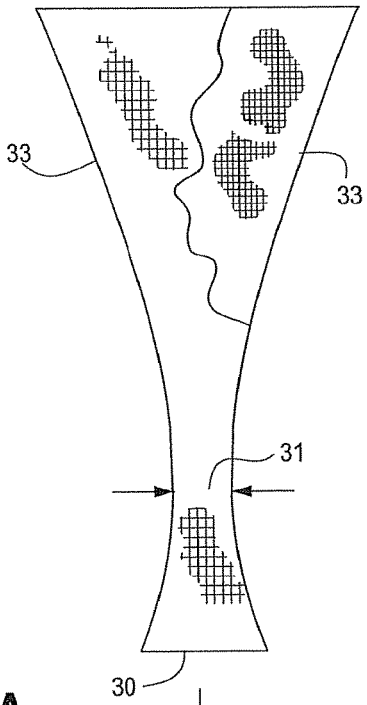
FIG. 6 is a plan view of a gusset, which was formed by attaching an elongated gusset liner pattern piece onto a body pattern piece of commensurate size, in accordance with one preferred embodiment of the invention.

In a third preferred embodiment ("the thong"), as shown in FIG. 5, the body 26 of the gusset is preferably cut from a single pattern piece. Across a vertical axis 27 of body pattern piece 26, there are two substantially symmetrical halves. The vertical outer edge of each half is generally concave. The horizontal edge at the top 29 of body pattern piece 26 is preferably approximately 6 inches in front and approximately 2 inches in the back at the bottom 30 of body pattern piece 26, but the dimensions can range from about ½ inch to about 8 inches or more. The width 31 at the narrowest point of the crotch region of body pattern piece 26 is preferably approximately one half inch and most preferably within the range of ½ to 2 inches.

Figure 7:
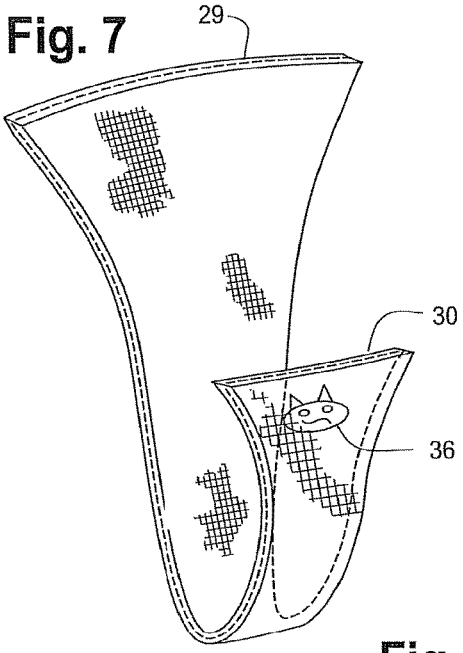
FIG. 7 is a rear perspective view of the gusset shown in FIG. 6 without the waistband.
Figure 6A:
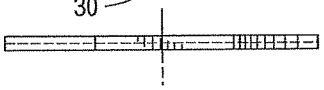
FIG. 6A is a front elevation view of the gusset shown in FIG. 6 which may be constructed from multiple fabric layers.
Figure 6B:
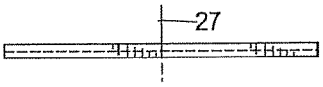
FIG. 6B is a rear elevation view of the gusset shown in FIG. 6 which may be constructed from multiple fabric layers.
Figure 6C:
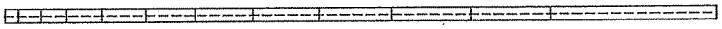
FIG. 6C is a right and left side elevation view of the gusset shown in FIG. 6 which may be constructed from multiple fabric layers.

Maintaining width 31 while increasing the length of horizontal edge at bottom 30 of body pattern piece 26 provides greater surface area on what will become the rear outer face of the undergarment, which preferably will provide space for the placement of a logo icon or other identifying characteristic 36, as seen in FIG. 7. Body pattern piece 26 can be made from many different possible materials, including any fabric, such as but not limited to cotton, polyester, lace, silk, modal, lace, or rayon, but the entire body piece 26 is preferably comprised of one or more layers of material, in which all layers are individually comprised of a single piece of the utilized material. Additional gusset liner pattern pieces may be cut to be commensurate in size with the dimensions of body pattern piece 26. Multiple gusset liner pattern pieces may comprise or be placed on top of the inner face of the body pattern piece 26 and attached along their outermost borders 33 outside protected region 11, thereby forming a one-, or multiply gusset 34 (see FIG. 7). Gusset liner pattern pieces 26 can be constructed from a single piece of any material, or may be multiple layers of any material, preferably and such as but not limited to cotton, silk, modal, bamboo, or rayon. The top and bottom edges 29, 30 of gusset 26 are attached to opposite sides of a stretchable waistband loop 37, which may be made from stretchable material, such that the resulting article is a thong-style undergarment (see FIG. 5). Due to the single body pattern piece 26 and overlaid gusset liner design, there are no seams in protected region 11 and no uncomfortable transitions from the gusset or gusset liner material to the body material anywhere within the borders of the protected sensitive genital region 11.

Figure 8:
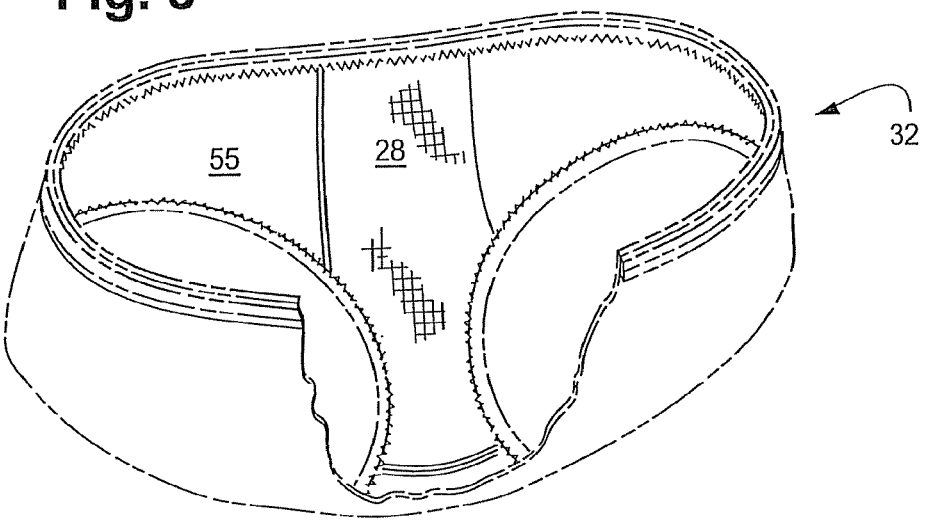
FIG. 8 is a rear perspective view of an elongated single-ply gusset piece, as affixed to a boy/girl short-style undergarment for women, in accordance with one preferred embodiment of the invention.
Figure 9:
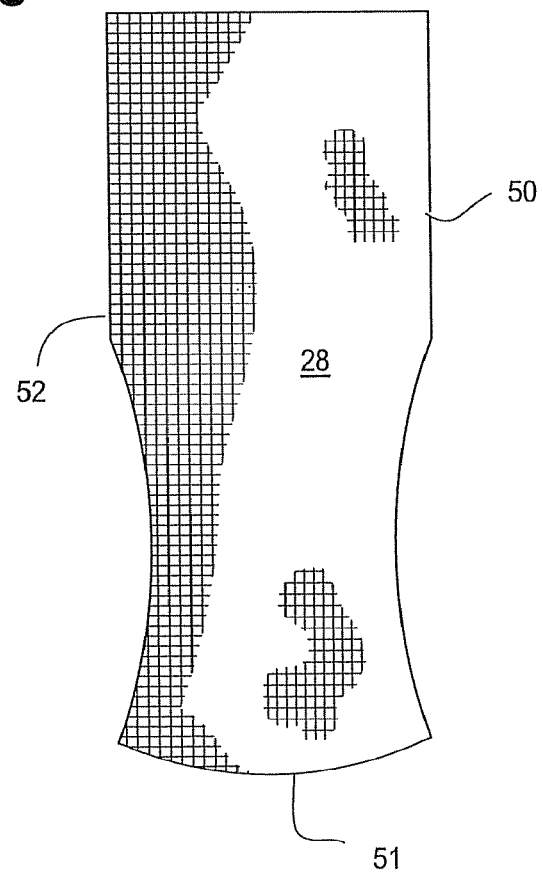
FIG. 9 is a plan view of an elongated gusset piece as shown in FIG. 8, in accordance with one preferred embodiment of the invention.

In a fourth preferred embodiment, as seen with reference to FIGS. 8 and 9, a boy/girl-shorts style garment 32 includes a preferably one- or multi-ply gusset 28. Gusset 28 extends from a point towards the bottom and rear of the garment 32 outside of the protected area 11 to a point at the front of garment 32 substantially at waistband 37. Preferably, garment 32 consists of just two body pieces 28, 55 of material attached only along the edges 50, 51, and 52 of gusset 28. Also preferably, gusset 28 liner is single-ply material, but may comprise multiple plies of any material.

Figure 10:
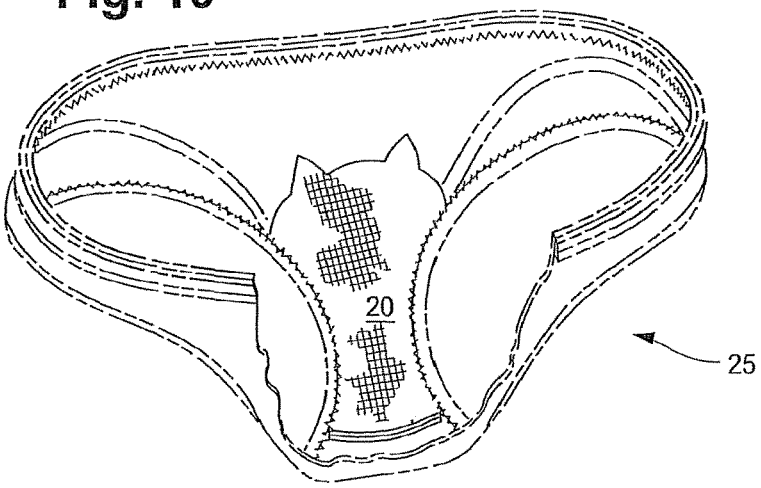
FIG. 10 is a rear perspective view of an elongated gusset piece with a front edge having an outline of a recognizable shape, as affixed to a bikini-style undergarment, and constructed from a single body pattern piece, in accordance with one preferred embodiment of the invention.
Figure 11:
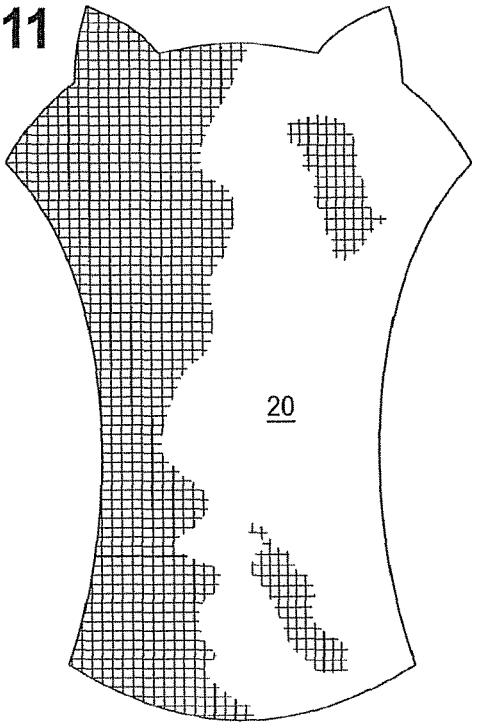
FIG. 11 is a plan view of an elongated gusset piece with top portion forming an outline of a recognizable shape, in accordance with one preferred embodiment of the invention as seen in FIG. 10.
Figure 11A:
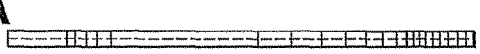
FIG. 11A is a front elevation view of the elongated gusset piece shown in FIG. 11 which may be constructed from multiple layers.
Figure 11B:
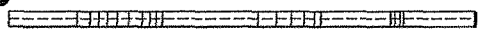
FIG. 11B is a rear elevation view of the elongated gusset piece shown in FIG. 11 which may be constructed from multiple layers.
Figure 11C:
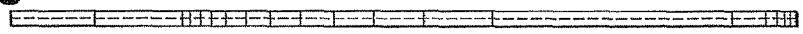
FIG. 11C is a right and left side elevation view of the elongated gusset piece shown in FIG. 11 which may be constructed from multiple layers.

In a fifth preferred embodiment ("the bikini-style"), as seen in FIG. 10, the elongated gusset 20 is incorporated into a low-rise, "bikini-style" undergarment 25. The body of the undergarment can be constructed from multiple pattern pieces or a single pattern piece, as described above in preferred embodiments one and two, respectively. Gusset 20 can be made from a single layer of any material, or multiple layers of one type of material, including but not limited to any material, such as cotton, silk, modal, or bamboo. Alternatively, gusset 20 can be made from any number of layers, where some, all, or none of the layers are made from the same material.

Figure 12:
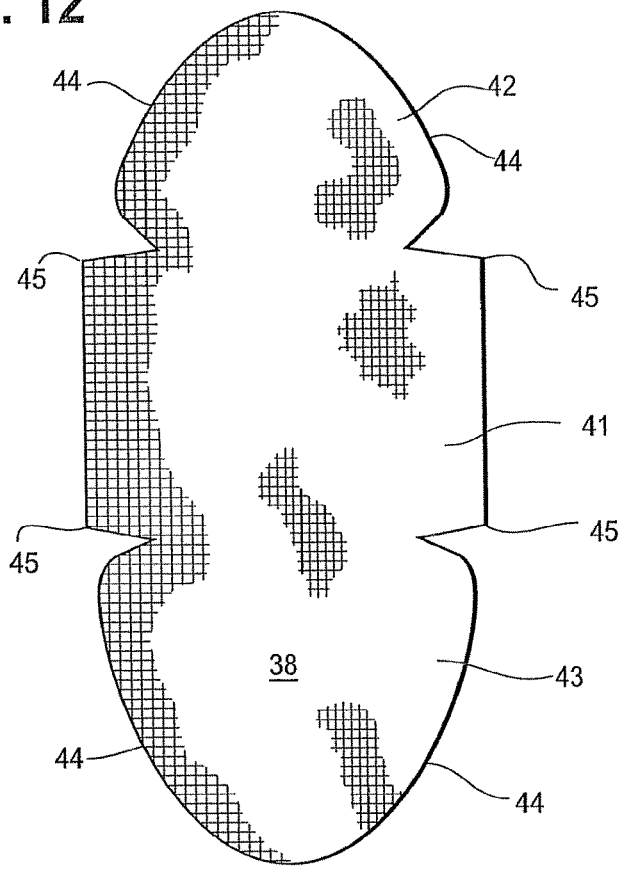
FIG. 12 is a plan view of an elongated gusset pattern piece having a central rectangular section and front and rear sections with curved edges, in accordance with one preferred embodiment of the invention.
Figure 12A:
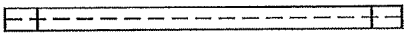
FIG. 12A is a front elevation view of the elongated gusset pattern piece shown in FIG. 12 which may be constructed from multiple layers.
Figure 12B:
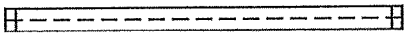
FIG. 12B is a rear elevation view of the elongated gusset pattern piece shown in FIG. 12 which may be constructed from multiple layers.
Figure 12C:
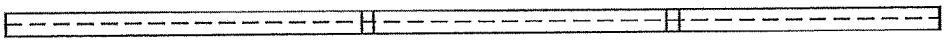
FIG. 12C is a right and left side elevation view of the elongated gusset pattern piece shown in FIG. 12 which may be constructed from multiple layers.
Figure 13:
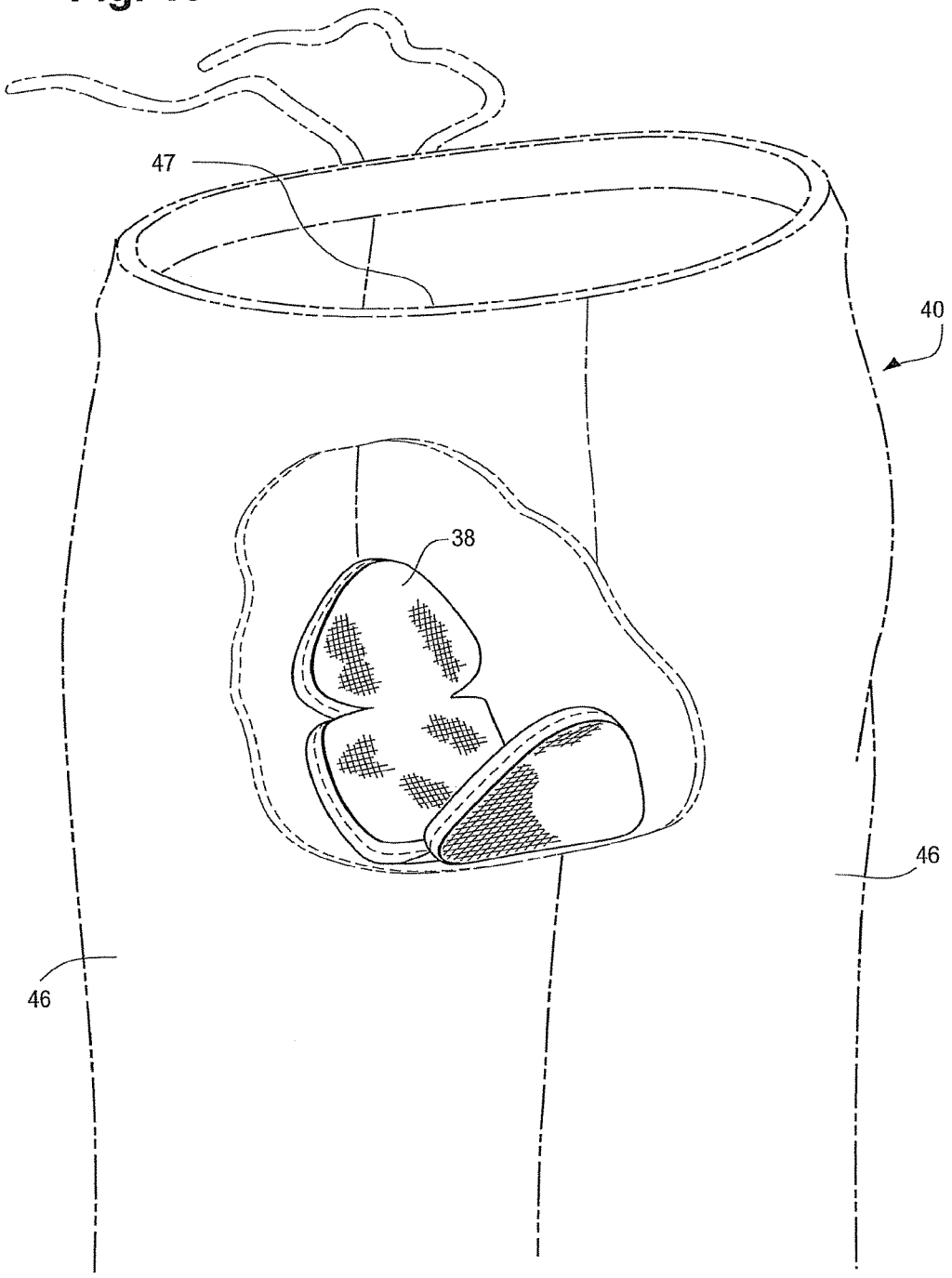
FIG. 13 is a rear perspective view of the elongated gusset pattern piece shown in FIG. 12 as incorporated into garment bottoms, in accordance with one preferred embodiment of the invention.
Figure 14:
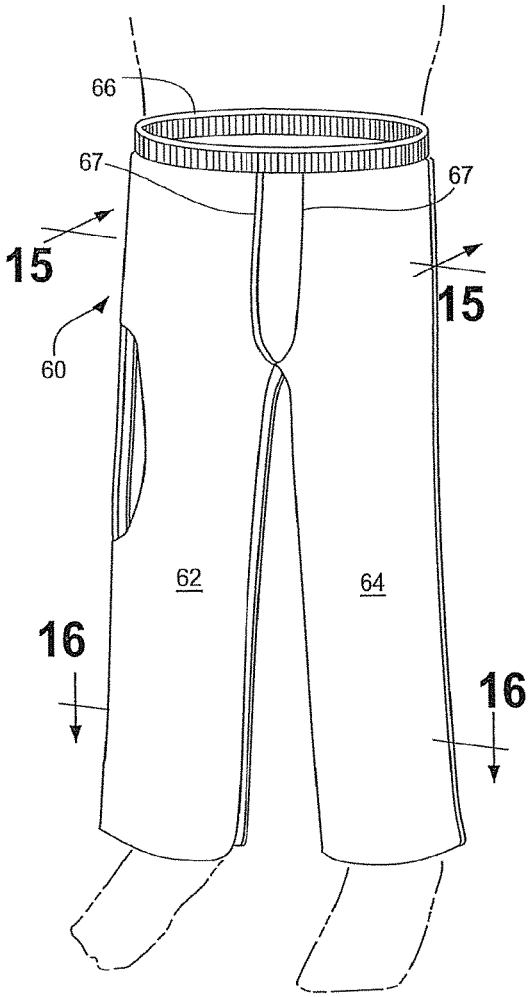
FIG. 14 is a perspective view of garment bottoms with raw seams moved to the exterior face of the garment out of direct contact with sensitive genital protected region.
Figure 15:
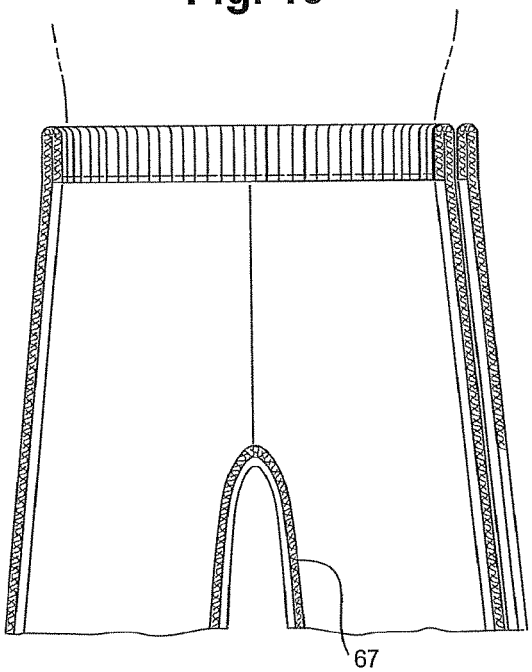
FIG. 15 is a plan view of a portion of the embodiment of FIG. 14 taken along the line 15-15.
Figure 16:
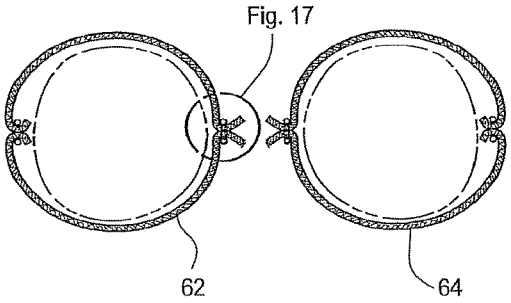
FIG. 16 is a plan view of a portion of the embodiment of FIG. 14 taken along the line 16-16.
Figure 17:
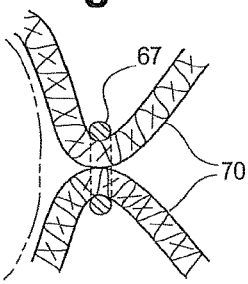
FIG. 17 is a plan view of a portion of the embodiment of FIG. 14 as referenced in FIG. 16.
Figure 18:
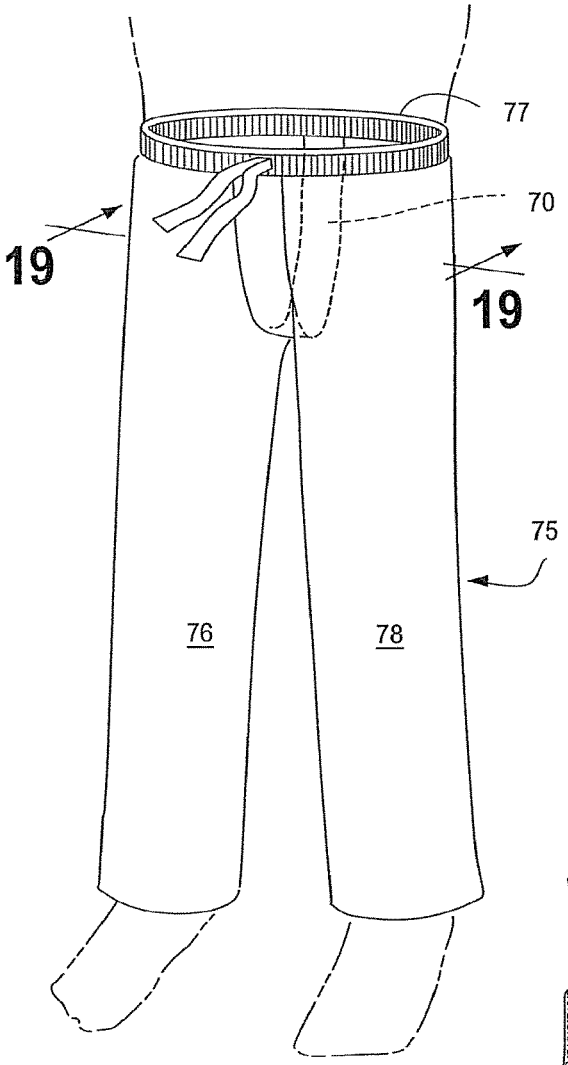
FIG. 18 is a perspective view of a pajama pants embodiment of the invention with a substantially rectangular gusset piece.
Figure 19:
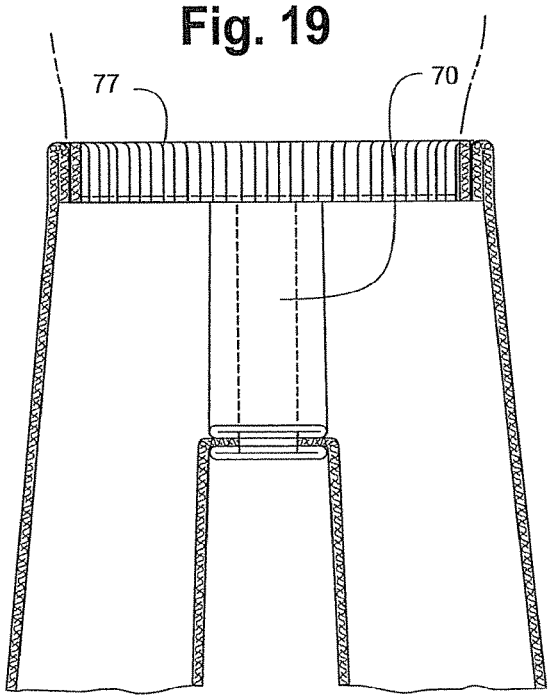
FIG. 19 is a plan view of the embodiment of FIG. 18 along the line 19-19 of FIG. 18.

In a sixth preferred embodiment ("pajama bottoms #1"), as shown in FIGS. 12 and 13, an elongated gusset 38 (see FIG. 12) comprises a crotch panel of a lower body garment. Gusset 38 can be incorporated onto any lower body garments as described herein and, as shown, is incorporated into of a pair of pajama bottoms 40. Gusset 38 has a central rectangular section 41 and a front section 42 and a rear section 43 with curved edges 44. Curved edges 44 of front section 42 and rear section 43 are tapered where sections 42, 43 meet central rectangular section 41. Front section 42 and rear section 43 of gusset 38 can be either the same size or different sizes. Alternatively, rear section 43 can be omitted altogether, or rear section 43 of gusset 38 can simply be generally rectangular. In a further preferred embodiment, the entire gusset 39 can be substantially rectangular.

As shown in FIG. 13, the leg pieces 46 of pajama bottoms 40 are sewn along the edges of gusset 38. Front section 42 of gusset 38 preferably extends at least 33% up the inner front face of pajama bottoms 40 toward the waistband 47 and, in any case, outside of protected region 11. Rear section 43 of gusset 38, if present, preferably extends sufficiently up the inner rear face of pajama bottoms 40 toward waistband 47. The relative distance will, of course, change depending on the overall size, shape, and rise of the garment. Gusset 38 can be made from a single layer of the same material from which the other pattern pieces of pajama bottoms 40 are made. Gusset 38 can also be constructed from one or more layers of different fabrics cut to be the same size and shape that are joined together. The top layer in multi-ply embodiments can be made of any material, such as but not limited to cotton, silk, flannel, jersey, or fleece. Preferably, the bottom layer in multiply embodiments can be made from the same fabric as the other pattern pieces of pajama bottoms 40.

As shown in FIGS. 14-17, an alternative lower body "pajama-style" garment 60 is provided. In this embodiment, the garment 60 consists generally of two pant leg pieces 62, 64, and a waistband 66. In prior art pajama pants, the seams of the leg pieces that are sewn together to construct the pants are stitched such that the extra material that protrudes from the stitching exists on the inside of the pants, and four seams converge in a central location in the genital region. Moreover, pajama pants are often constructed of bulkier materials such as flannel, fleece, and the like; which causes the seams to be especially thick, which renders the location of the seams in the protected region especially problematic. In the embodiment shown in FIGS. 14 to 17, all of the seams 67 that traverse any part of the protected region are configured such that the material 70 that extends from the seam extends external of the pants 60, as seen best with reference to FIGS. 16 and 17. This novel construction, having all crotch seams on the outer face, external to the wearer provides increased comfort to the wearer.

Figure 20:
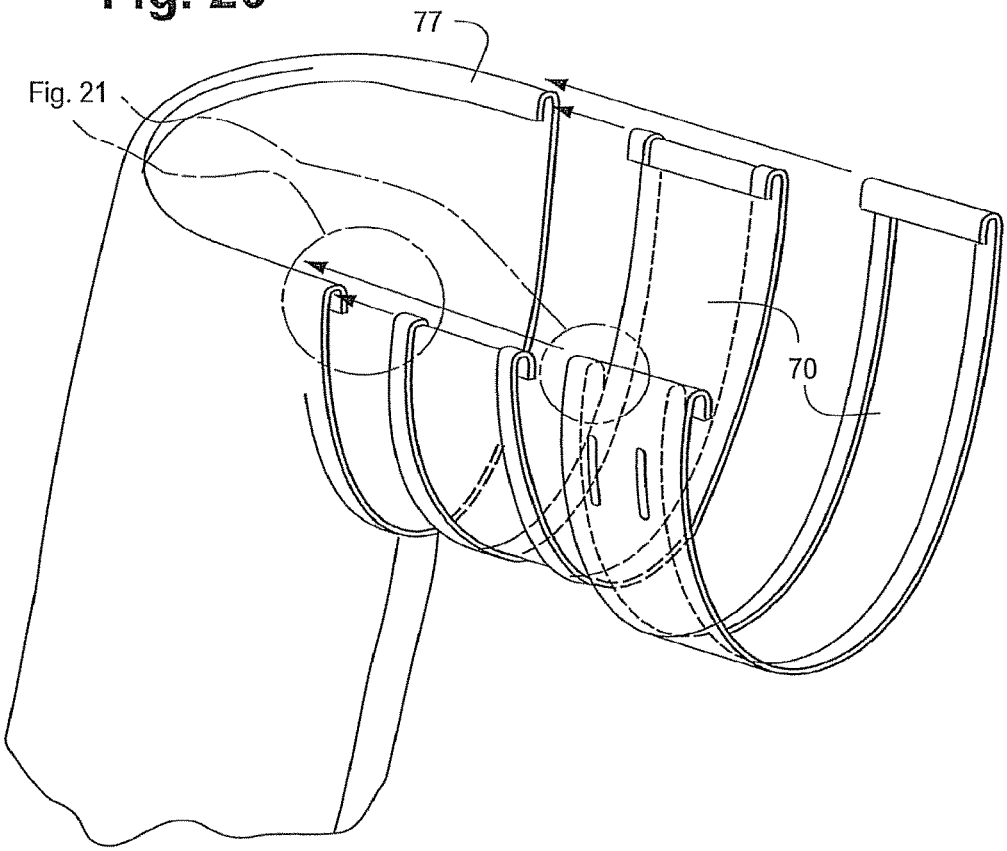
FIG. 20 is an exploded perspective view of a portion of the embodiment of FIG. 18 showing a 2-ply gusset with a pant leg.
Figure 21:
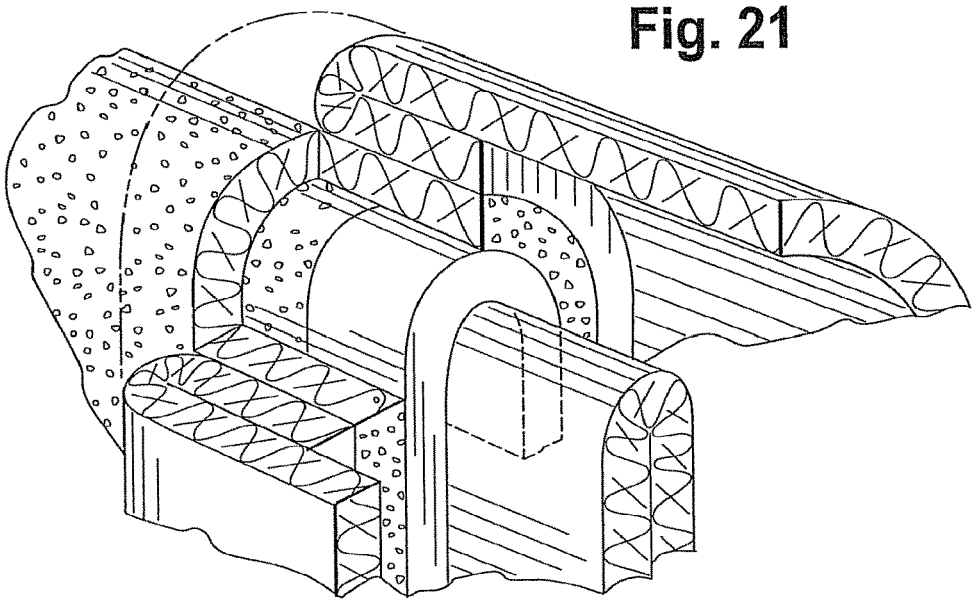
FIG. 21 is a perspective view of a portion of the embodiment of FIG. 20 as referenced in FIG. 20.
Figure 22:
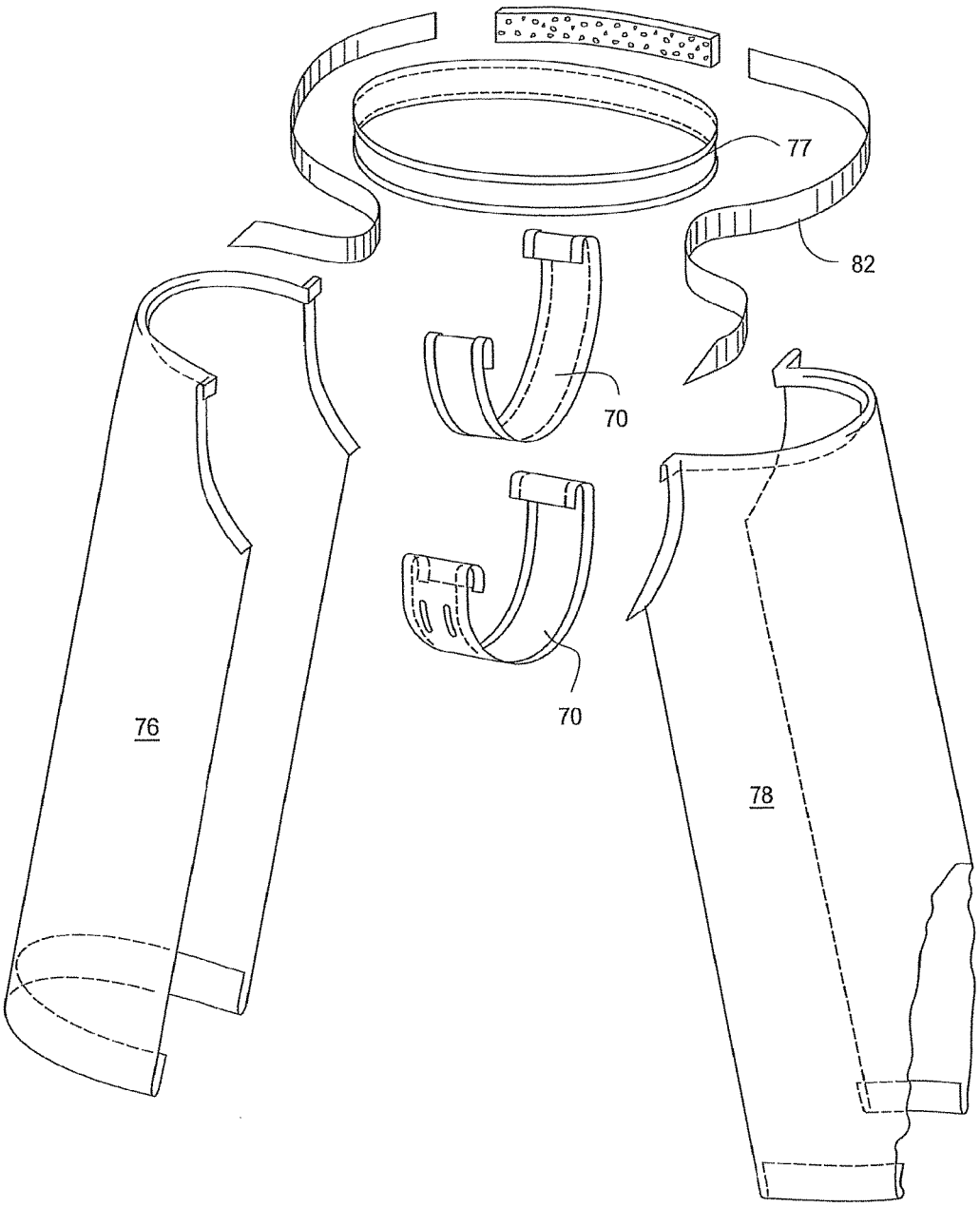
FIG. 22 is a perspective exploded view of the pieces of a pajama pants embodiment of the present invention.

In another preferred embodiment, a novel gusset 70 is utilized in a pajama-pant garment 75, as seen in FIGS. 18-22, which adds additional comfort to the wearer. Gusset 70 is substantially rectangular, and when incorporated into pants 75 extends from the front of waistband 77 of pants 75 to the rear of waistband 77. As shown in FIGS. 20-22, gusset 70 may comprise one piece of material, or multiple pieces of material, and can be sewn into waistband 77 of pants 75. Furthermore, gusset 70 provides the attachment means between pant legs 76, 78 of pants 75, as best seen with respect to FIG. 22. This construction of pants 75 utilizing gusset 70 provides superior comfort to the wearer while also mitigating upward migration of the garment that tends to occur through normal use of such garments.

For each preferred pajama-bottom embodiments, all seams can be moved to the exterior face of the garment such that the raw seams are out of direct contact with protected region 11, and are thus visible on the outside of the garment when it is worn, as seen best with reference to FIGS. 14-17.

Having described certain embodiments of the invention, it should be understood that the invention is not limited to the above description or the attached exemplary drawings. Rather, the scope of the invention is defined by the claims appearing herein below and any equivalents thereof as would be appreciated by one of ordinary skill in the art.

What is claimed is:

1. A lower body garment comprising:

a body including a protected portion configured to cover a protected region of a wearer and an unprotected portion configured to cover an unprotected region of the wearer outside of the protected region of the wearer, the body having a front face and a rear face opposite the front face, and a crotch portion extending between the front face of the body and the rear face of the body;

a gusset located on the body and configured to substantially cover the protected region of the wearer and at least a portion of the front face, the crotch portion, and the rear face, the gusset comprising:

two side edges, a top front edge, and a rear edge that collectively form an outer edge that defines an outline of the gusset, the top front edge being within the front face of the body, the gusset extending to the rear edge located at the rear face of the body;

a transverse axis bisects an elongated length of the gusset, wherein a portion of the gusset bound by the transverse axis, a first portion of each of the side edges and the top front edge defines a front area of the gusset, and a portion of the gusset bound by the transverse axis, a second portion of each of the side edges and the rear edge defines a rear area of the gusset, the front area and the rear area both extending from the crotch portion and to the outer edge; and the front area of the gusset being larger than the rear area of the gusset and wherein the rear area of the gusset is located near the rear face of the body, the front area of the gusset is located near the front face of the body, and the rear face of the body includes more surface area than the front face of the body.

2. The lower body garment of claim 1, wherein the gusset is a separate piece of fabric from the body.

3. The lower body garment of claim 1, further comprising a waistband and wherein the outline is spaced from the waistband.

4. The lower body garment of claim 1, further comprising a seam connecting the gusset to the body, wherein the seam is configured to be located only within the unprotected region of the wearer.

5. The lower body garment of claim 1, wherein the waistband comprises a stretchable top portion around a top circumference of the body.

6. The lower body garment of claim 1, wherein the gusset extends 75% of a length measured from a bottom point of the lower body garment to the waistband.

7. The lower body garment of claim 1, wherein the gusset extends 83% of a length measured from a bottom point of the lower body garment to the waistband.

8. The lower body garment of claim 1, further comprising leg openings defined by the body, the seam connecting the gusset to the body and at least a portion of the seam being spaced from the leg openings.

9. The lower body garment of claim 1, wherein the rear face is configured to project outward more than the front face.

10. A lower body garment comprising:

a body having a front face and a rear face opposite the front face, and a crotch portion extending between the front face of the body and the rear face of the body;

a gusset attached to the body and comprising:

two side edges, a top front edge, and a rear edge that collectively form an outer edge, the top front edge being at or near the front face of the body and the rear edge being at or near the rear face of the body;

a transverse axis bisecting an elongated length of the gusset, wherein a portion of the gusset bound by the transverse axis, a first portion of each of the side edges and the top front edge defines a front area of the gusset, and a portion of the gusset bound by the transverse axis, a second portion of each of the side edges and the rear edge defines a rear area of the gusset, the front area and the rear area both extending from the crotch portion and to the outer edge; and the front area of the gusset is larger than the rear area of the gusset and wherein the rear area of the gusset is located at or near the rear face of the body, the front area of the gusset is located at or near the front face of the body, and the rear face of the body includes more surface area than the front face of the body.

11. The lower body garment of claim 10, wherein the gusset is a separate piece of fabric from the body.

12. The lower body garment of claim 10, further comprising a waistband and wherein the outline is spaced from the waistband.

13. The lower body garment of claim 10, further comprising a seam connecting the gusset to the body, wherein the seam is configured to be located only within the unprotected region of the wearer.

14. The lower body garment of claim 10, wherein the waistband comprises a stretchable top portion around a top circumference of the body.

15. The lower body garment of claim 10, wherein the gusset extends 75% of a length measured from a bottom point of the lower body garment to the waistband.

16. The lower body garment of claim 10, wherein the gusset extends 83% of a length measured from a bottom point of the lower body garment to the waistband.

17. The lower body garment of claim 10, further comprising leg openings defined by the body, the seam connecting the gusset to the body and at least a portion of the seam being spaced from the leg openings.

18. The lower body garment of claim 10, wherein the rear face is configured to project outward more than the front face.

* * * * *